US005492173A

United States Patent [19]

Kilgore et al.

[11] Patent Number: 5,492,173

[45] Date of Patent: Feb. 20, 1996

[54] PLUG OR LOCK FOR USE IN OIL FIELD TUBULAR MEMBERS AND AN OPERATING SYSTEM THEREFOR

[75] Inventors: Marion D. Kilgore, Dallas; Imre I. Gazda, Fort Worth; David L. Reesing, Irving; John H. Yonker, Carrolton, all of Tex.

[73] Assignee: Halliburton Company, Houston, Tex.

[21] Appl. No.: 28,963

[22] Filed: Mar. 10, 1993

[51] Int. Cl.[6] ..... E21B 23/01

[52] U.S. Cl. ..... 166/66.4

[58] Field of Search ..... 166/66.4, 65.1, 166/123, 124

[56] References Cited

U.S. PATENT DOCUMENTS

| | | | |
|---|---|---|---|
| 3,381,751 | 5/1968 | McLelland | 166/66.4 |
| 3,485,299 | 12/1969 | Young | 166/66.4 |
| 3,661,205 | 5/1972 | Belorgey | 166/66.4 |
| 4,094,359 | 6/1978 | King | 166/66.4 |
| 4,116,274 | 9/1978 | Rankin et al. | 166/250 |
| 4,124,070 | 11/1978 | King et al. | 166/255 |
| 4,243,099 | 1/1981 | Rodgers, Jr. | 166/66.4 |

*Primary Examiner*—Hoang C. Dang
*Attorney, Agent, or Firm*—William M. Imwalle; Shawn Hunter

[57] ABSTRACT

A retrievable well lock for use within a subterranean member is used in cooperation with a tool for setting the lock. The lock will include an actuation assembly which is operable in response to longitudinal movement between portions of the lock. The setting tool will preferably include a power source within a housing assembly which can be selectively coupled to or decoupled from the lock assembly. The power source is associated with the setting tool through an activation assembly which will cause movement of a movable mandrel within the setting tool facilitating the selective actuation of the lock.

6 Claims, 8 Drawing Sheets

PLUG OR LOCK FOR USE IN OIL FIELD TUBULAR MEMBERS AND AN OPERATING SYSTEM THEREFOR

BACKGROUND OF THE INVENTION

The present invention relates generally to improved barrier members, such as "plugs" or "locks" adapted for use in subterranean wells; and more particularly, to improved plugs or locks and associated operating systems, and methods of their use in oilfield tubular members, such as casing or tubing strings.

The use of plugs or locks in oilfield tubular members is well known in the art. A packer-type lock, as particularly described relative to the preferred embodiment herein, is typically intended to be placed in the tubular member, such as a subsurface tubing string, and to securely and sealingly engage the interior wall of the tubing string. Once in place, the lock provides fluid and pressure isolation between sections of the tubing string.

Many such lock systems have been developed in which landing nipples or profiles are provided at points along the tubing string's interior surface, and wherein a lock will be placed in the nipple or profile. However, placement of a lock of this type is limited to those points along the string at which an appropriate nipple or profile is located.

A few plugs are known which are "nippleless" in that they do not require the presence of a nipple or profile to be set within a string or wellbore. Nippleless systems offer the capability to set plugs at substantially any depth or point within a subterranean well. These systems also reduce the need to foresee, at the time tubing or casing is placed, where a packer device will later be needed.

Conventional methods of running and pulling nippleless plugs or locks, however, typically require that actuating power be supplied from the surface to the running or pulling assemblies performing these functions. This requires, therefore, that the tools be run on wireline, rather than slickline (without an electrical conductor), as is used for many other types of well operations. This requirement increases the equipment needs, and the cost of the operation of setting or pulling the plug or lock.

There are techniques which do not rely upon surface-supplied electrical power to set a lock. These systems, however, typically rely upon an explosive charge to set the lock. Rapid setting sequences, and particularly those performed as rapidly as is typically achieved through use of explosive devices are detrimental in that they adversely affect the quality of the setting of each member. For example, slip elements are known to set more securely when they engage tubing or casing in a controlled manner. Further, elastomeric packer elements establish a better seal when the elastomeric material is deformed gradually, and stresses within the-material are thereby allowed to equalize more gradually, thereby minimizing subsequent relaxation of the elastomer, with an accompanying reduction in sealing effectiveness.

Many existing slip designs employ radially segmented slip elements which are urged outward to engage the interior wall of the surrounding tubing string. The slip elements are often separated from each other a significant distance. If the slip is being set in a non-vertical tubing string, the elements may expand non-uniformly resulting in the lock being decentralized within the string. As a result, a pressure differential across the lock will be more likely to result in failure of the lock's slips due to the unequal forces upon the slips and packing element around the circumference of the lock.

Conventional designs for packer-type locks offer a further disadvantage in removal operations. After a packer-type lock is set and subjected to a period of high temperature and pressure, the packing element will typically achieve some degree of "set" toward the expanded state. This "set" of the packing element may also be considered as an absence of "memory" of the packing element for its original form. The distended exterior diameter may make removal of the lock difficult as it reduces the fluid bypass around the lock, and may provide difficulty in clearing areas of relatively restricted diameter, such as an uphole nipple or profile.

In a related aspect, retrieving or "pulling" operations for locks typically rely upon engaging a set lock with a wireline device and pulling or jarring the lock upward in an attempt to dislodge it from within the tubing string. This technique is not always successful and sometimes results in either damage or "hanging up" of the lock within the tubing string.

Accordingly, the present invention provides a new barrier device, such as a lock (or "plug") and associated methods and apparatus for setting and pulling the barrier device without the requirement of a nipple or profile; and which, in a preferred embodiment, facilitates both controlled, gradual, setting of the device, and release of the device without jarring.

SUMMARY OF THE INVENTION

The retrievable well lock in accordance with the invention preferably includes a mandrel assembly which supports a slip assembly. The slip assembly is preferably operable between a first, relatively reduced diameter, state or condition, and a second, relatively expanded diameter, state or condition. In a preferred embodiment, the lock includes an actuation mechanism or assembly which includes at least two generally longitudinally opposed and relatively longitudinally moveable annular wedges. In a preferred embodiment, the slip assembly includes a generally circumferentially continuous and radially variable body member. In a particularly preferred implementation, the body member is constructed to have a structural construction extending to define a plurality of anchoring slips in a generally serpentine form, such form established by a plurality of opposed and interleaved slots. The actuation assembly is operatively coupled to the body member to selectively cause radial expansion of the anchoring slips.

The lock preferably also includes a packing assembly which includes an elastomeric sleeve which is again, moveable between a first, relatively radially retracted, condition, and a second, relatively radially expanded, condition. In one preferred implementation, the elastomeric sleeve is coupled to the actuation assembly such that the sleeve will be maintained under divergent axial tension when the sleeve is in the first, relatively radially retracted position. One particularly preferred embodiment of elastomeric sleeve includes a central portion having a relatively softer, and therefore relatively more easily deformable central portion, with the longitudinally opposed end portions being of a relatively harder elastomeric compound. This particularly preferred embodiment further comprises a novel notched retaining system between an actuation assembly and the elastomeric sleeve which minimizes stress upon the sleeve during deformation.

One preferred embodiment of a running tool, in accordance with the present invention and adapted to operate the well lock of the present invention, includes a power assembly including both a self-contained power source, such as a bank of batteries, and a force generator operable through application of power from the power source. The force generator will preferably be a mechanism such as a jack-screw type mechanism, capable of imparting a translational force to a working assembly of the running tool. This working assembly will preferably cause relative movement between two portions of the working assembly, which relative movement will exert a force on a portion of the actuation assembly of the lock to cause actuation and setting of the lock within a string of tubing or other tubular member. This preferred embodiment of running tool is adapted to cause gradual longitudinal movement of portions of the lock actuation assembly such that the lock is set over an extended period of time. This period of time should be over approximately one minute, and most preferably over five minutes.

A preferred embodiment of a pulling tool in accordance with the present invention and suitable for use with the lock of the present invention will also include a self-contained power source such as a bank of batteries, and a selectably actuable force generator for establishing opposing longitudinal movement between two members. In one preferred implementation, the power assembly of the pulling tool and the running tool will be essentially identical. The pulling tool will preferably include a working assembly which is adapted to apply a translational force to a portion of the mandrel assembly of the lock to facilitate releasing or "unsetting" of the lock.

DETAILED DESCRIPTION OF PREFERRED EMBODIMENTS

The present invention relates generally to well locks, and to methods and systems facilitating the placement and retrieval of such locks within a tubular member, such as a tubing string, within a wellbore.

The invention will be described in reference to a preferred embodiment of a packer-type well lock having both slips and a deformable packing element. Such a packer-type well lock may be adapted to serve as a bridge plug or as a hanger for other types of equipment, as is well known to the art. The present invention has particular application to well operations conducted through use of "slickline" as the invention allows placement and retrieval of a well lock without the need to transmit power downhole from the surface. Further, the lock of the present invention is "nippleless", and thus may be placed at substantially any point within a tubing string without requiring a pre-placed matching landing nipple or profile into which the lock must mate.

Figure 1:
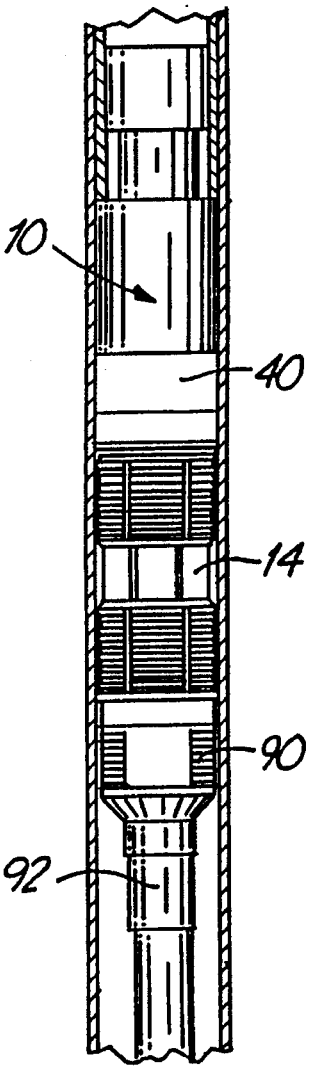
FIG. 1 is a side exterior view of an exemplary packer-type well lock in accordance with the present invention depicted as "set" within a tubing string in an exemplary implementation of the invention.

Referring now to FIG. 1, therein is shown an exemplary lock 10, in accordance with the present invention, depicted in an operating environment disposed within a tubing string 11. Although lock 10 will be discussed in reference to a tubing string 11, it should be clearly understood that lock 10 may also be placed in a casing string, drill string, or other tubular member as is well known to the industry. Referring now also to FIG. 2, therein is depicted lock 10 in greater detail, illustrated substantially in vertical section. Lock 10 comprises a support mandrel assembly 12, which supports a barrel slip assembly 14. Barrel slip assembly 14 is operable between a reduced diameter condition by which lock 10 may be placed into or removed from the tubing string, and an expanded diameter condition by which barrel slip assembly 14 is set and mechanically engages the tubing.

Lock 10 also includes a packing assembly 40 which is also movable between a relatively reduced diameter condition, and a relatively expanded diameter condition (as depicted in FIG. 1), whereby packing assembly. 40 sealingly engages the interior of the tubing string to provide fluid and pressure isolation of one section of the tubing string from another.

Figure 2A:
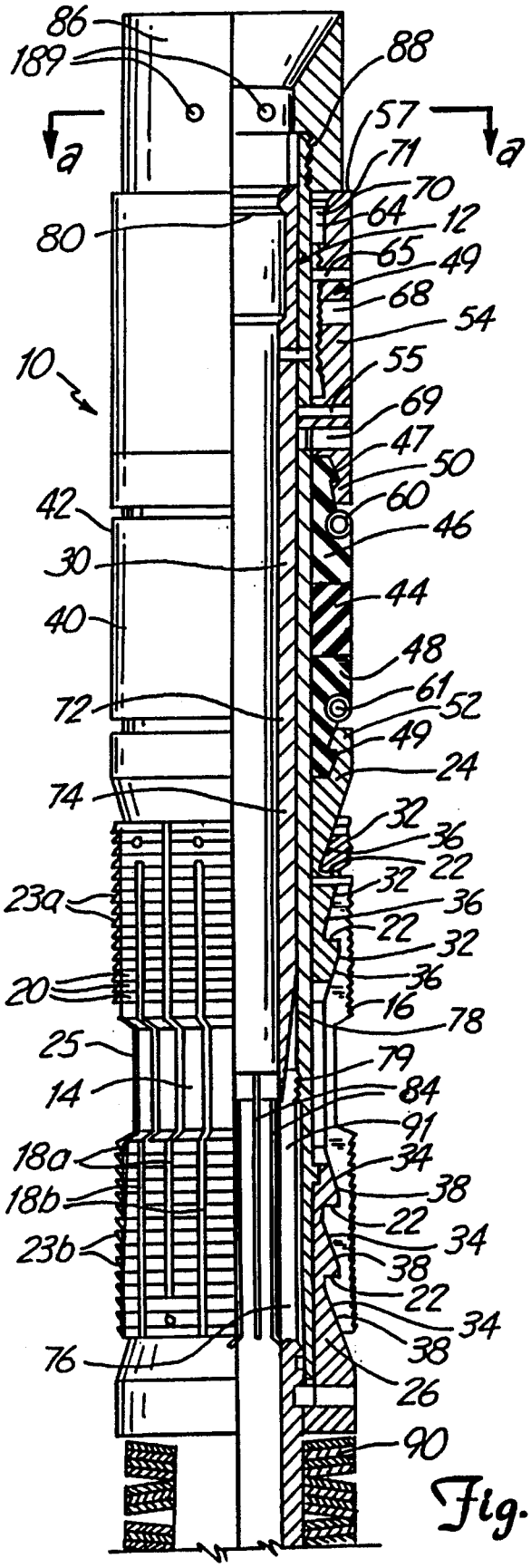
FIGS. 2A and 2B are partial cutaway views of an exemplary packer-type well lock in accordance with the present invention depicted in an unset position.
Figure 2B:
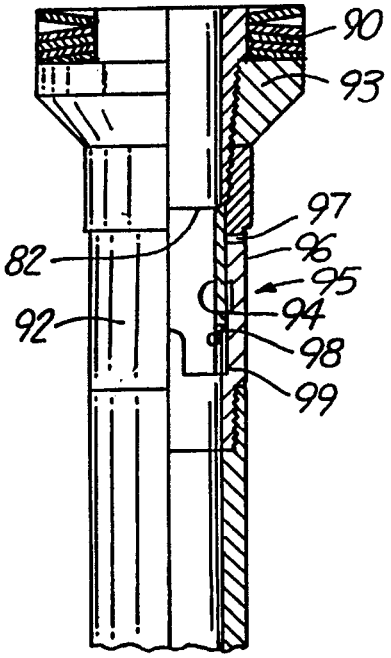

As best seen in FIG. 2A, barrel slip assembly 14 preferably includes a one-piece slip body 16 which surrounds a portion of lock 10 in a circumferentially continuous manner, such that slip body 16 is unbroken at any point around the lock 10. Slip body 16 comprises a plurality of anchoring slips 20 which are configured to be radially expansible. The generally circumferentially continuous construction of slip body 16 is obtained by providing a plurality of interleaved slots 18 which define interleaved anchoring slips 20. As can be seen in FIG. 2A, a first plurality of slots 18*a* extend into slip body 16 from the lower extent of slip body 16, while a second plurality of slots 18*b* extend into slip body 16 from the upper extent of slip body 16. The slots 18 defining anchoring slips 20 pass through most, but not all, of the axial length of slip body 16. The resulting serpentine structure defines an arrangement of anchoring slips 20 which may expand radially. Slots 18 are preferably smaller in width than anchoring slips 20 so that anchoring slips 20 will comprise a majority of the circumferential surface of slip body 16. Testing has indicated that this slotted one-piece construction permits a significant amount of radial expansion. For example, a barrel slip assembly 14 having a 4.52" inch nominal, unexpanded, diameter, and having 20 anchoring slips 20 defined by 20 slots (10 cut from either axial end) of approximately 0.12 inches in width will facilitate expansion with adequate setting force to at least approximately 4.90 inches. The internal surface of slip body 16 includes opposing sets of tapered surfaces 36 and 38, respectively, each such surface 36 or 38 coupled to other surfaces in the set by tooth-like engaging surfaces 22.

Each anchoring slip 20 is preferably provided with opposing sets of anchoring teeth 23*a*, 23*b* upon longitudinally opposed portions of its exterior surface. Anchoring teeth are adapted to mechanically engage the interior surface of a tubing string when barrel slip assembly 14 is set. Opposed anchoring teeth 23*a*, 23*b* are each directional to resist axial movement of lock 10, within the tubing string in either axial direction. An annular relief 25 is preferably provided along the length of slip body 16. The relief offers a smaller, recessed, cross-section to permit flexibility during expansion of slip body 16.

Figure 9A:
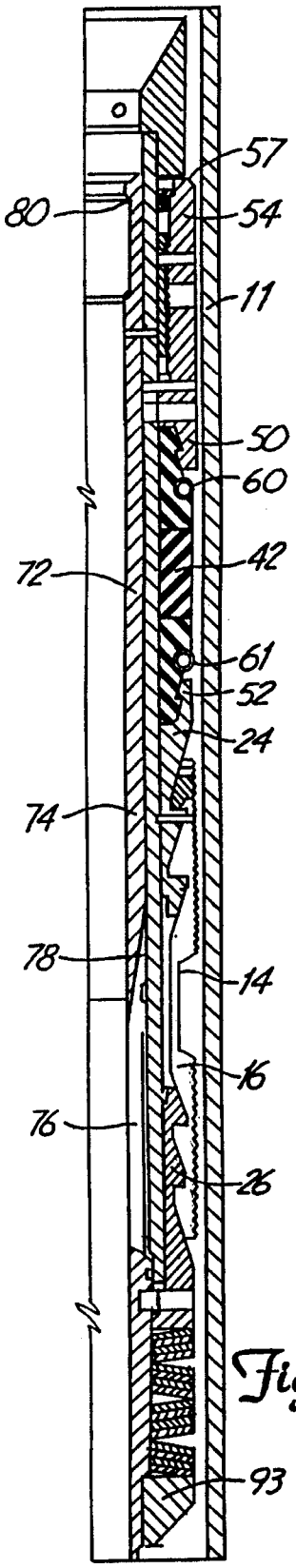
FIGS. 9A–9C are partial cutaway views showing an exemplary lock in expanded and reduced diameter conditions.

Barrel slip assembly 14 further includes an actuation assembly which includes upper and lower annular wedge assemblies 24 and 26 which are adapted to be longitudinally movable relative to each other along an outer mandrel 30. Slip body 16 is configured to engage and cooperate with wedge assemblies 24 and 26 in such a manner that converging longitudinal movement of annular wedge assemblies 24 and 26 causes radial expansion of slip body 16. Specifically, each annular wedge 24 and 26 includes a plurality of preferably annular tapered ridges 32 and 34, respectively, which engage complimentary generally annular inclined surfaces 36 and 38, respectively, along the internal surface of anchoring slips 20 of slip body 16. Tapered ridges 32 and 34, and complimentary inclined surfaces 36 and 38, are tapered in opposing directions, such that converging longitudinal movement of annular wedges 24 and 26 will act upon longitudinally relatively fixed inclined surfaces 32 and 34 of slip body 16 to urge anchoring slips 20 radially outwardly. This relationship may be seen by comparing FIG. 9A, wherein barrel slip 14 is depicted in its relatively reduced diameter condition, to FIG. 9B, wherein barrel slip assembly 14 is depicted in its relatively expanded diameter condition upon divergent axial movement of annular wedges 24 and 26. The engagement of engaging surfaces 22 of slip body 16 with complimentary tooth-like surfaces 37 and 39 of wedge assemblies 24 and 26 enable slip body 16 to transmit an axial tensile load across its length when in its reduced diameter condition.

The structure of barrel slip assembly 14 preferably permits slip body 16 to be moved substantially uniformly from its reduced diameter condition toward its expanded diameter condition. As a result, upon actuation anchoring slips 20 will typically be substantially uniformly extended relative to the remainder of lock 10, thereby effectively centralizing lock 10 with the tubing string, and thereby promoting optimal engagement with the tubing string.

Referring once more to FIG. 2A, lock 10 features a novel annular packing assembly 40 having a substantially elastomeric sleeve 42 which is also operable between an expanded diameter condition and a reduced diameter condition by virtue of axial compression. Annular packing assembly 40 is concentrically disposed relative to outer mandrel 30 of support mandrel assembly 12, and is disposed at a relatively uphole position relative to barrel slip assembly 14. A longitudinally central portion 44 of elastomeric sleeve 42 is preferably formed of a softer elastomeric material than that utilized to form either axial end 46, 48 so that the central portion 44 of sleeve 42 is more easily radially extruded to an expanded diameter condition. The sleeves are typically constructed by unitary molding of elastomeric pieces having differing hardnesses. The pieces are molded together under heat and pressure to form a single sleeve with portions of varying hardness. Effective sleeves have been constructed with a central portion having a 70 durometer hardness measure and axial ends of 90 durometer measure. In the expanded diameter condition, central portion 44 of sleeve 42 radially extrudes to effect a seal against the interior surface of the surrounding tubing string.

Elastomeric sleeve 42 also includes at least one, and most preferably at least two, annular reinforcement members 60, 61 which are molded therein proximate the outer surface. Reinforcement members 60, 61 will preferably each be a coiled spring. Reinforcement members 60, 61 serve to resist axial extrusion of sleeve 42 beyond the reinforcement member as sleeve 42 is moved toward an expanded diameter condition.

Axial ends 46 and 48 of elastomeric sleeve 42 are configured with lips 47 and 49 configured to engage generally matching notched retaining members 50 and 52, respectively. Notched retaining member 50 is preferably formed as a part of an upper compression member 54. Notched retaining member 52 is preferably formed as a part of upper annular wedge 24. Compressional force may be applied to elastomeric sleeve 42 through engaging surfaces of notched retaining members and elastomeric sleeve 42.

A particular structure is preferred for the engagement of each lip 47, 49 of the elastomeric sleeve, with respective notched retaining members 50, 52 respectively. This structure will be described relative to upper lip 47 and notch retaining member 50, with the understanding that a similar structure is provided relative to lip 49 and notched retaining member 52. The structural arrangement is best appreciated with reference to FIG. 3. The elastomeric sleeve 42 includes a thrust surface 71 which engages a complimentary thrust surface 41 on notched retaining member 50. Thrust surfaces 71 and 73 each preferably extend generally perpendicularly to the longitudinal axis of the tool. A retaining lip 75, on notched retaining member 50 engages a complimentary lip 79 on lip 47 to provide engagement therewith, and to facilitate the application of tension to elastomeric sleeve 42. Elastomeric sleeve then defines a connecting surface 81 which extends toward a central primary diameter section of elastomeric sleeve 42. In the depicted preferred embodiment, this primary diameter section, indicated generally at section 83, forms the primary sealing portion of elastomeric sleeve 42, and extends between re-enforcement members 60 and 61 which are placed at each longitudinal extent of this primary sealing section 83. Connecting surface 81 of elastomeric sleeve is specifically sized relative to the dimension of notched retaining member 50, to define a gap 85 between the end 87 of notched retaining member 50 and the adjacent surface at a given diameter of elastomeric sleeve 42. In the depicted embodiment, this adjacent surface is defined by retaining member 60. In one preferred embodiment this gap will be approximately 0.186 inch. Additionally, the inner terminating portion of surface 87 of notch member 50 preferably defines general gradual radius 88, for example approximately 0.10 inch, to further facilitate deformation of elastomeric seal 42 around surface 47 of notched retaining member 50 while minimizing stresses in a transitional portion of elastomeric seal 42, as indicated generally at 89 between the dashed lines.

When lock 10 is assembled in an initial "running-in" configuration, elastomeric sleeve 42 will preferably be sized relative to the spacing between notched members 50 and 52 such that elastomeric sleeve 42 is "at rest" (i.e., no substantial tensional stresses are placed thereon). However, as described earlier herein, after being set in a well, elastomeric elements such as elastomeric sleeve 42 will typically assume some degree of "set" thereby losing some of the "memory" of its original form and dimension. The described engagement between notched retaining members 50 and 52 facilitates the application of axial tension to elastomeric sleeve to overcome any such "set" otherwise observed in elastomeric sleeve 42. Divergent longitudinal movement of notched retaining members 50 and 52 (as will result upon un-setting of lock 10) will axially draw elastomeric sleeve 42 from the expanded diameter condition to the reduced diameter condition, and will maintain sleeve 42 under divergent axial tension to minimize the diameter of sleeve 42.

Figure 3:
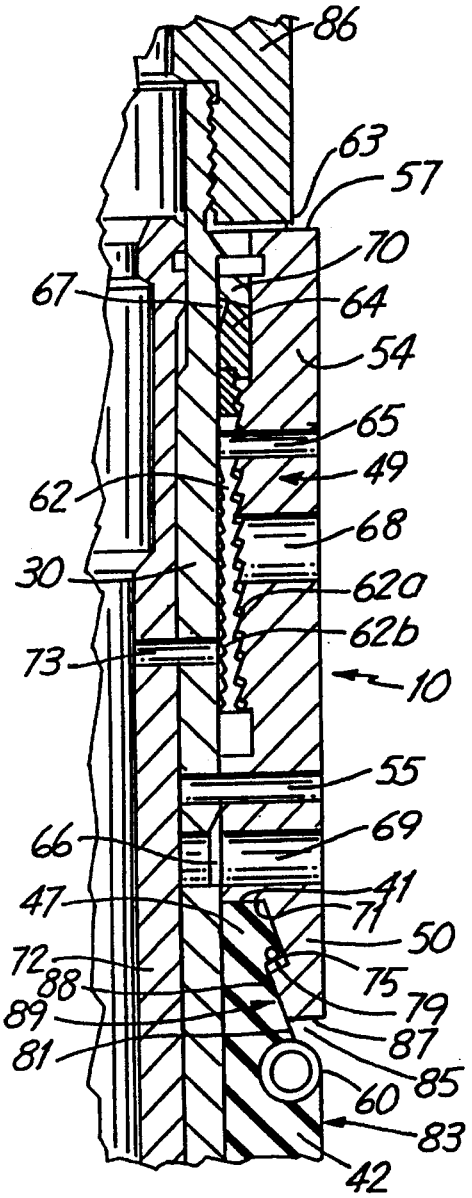
FIG. 3 is a detail of an exemplary axial compression member and associated components.
Figure 4:
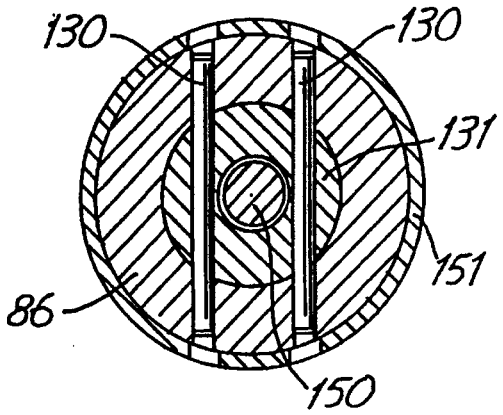
FIG. 4 is a cross-sectional view at line a—a of FIG. 2A showing an exemplary connection between a running tool and lock.
Figure 8:
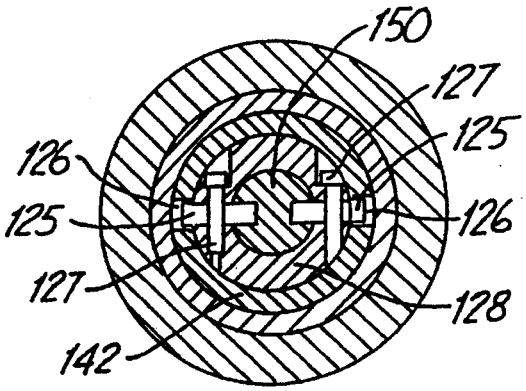
FIG. 8 is a cross-sectional view at line b—b of FIG. 7 showing portions of an exemplary clutch mechanism of the present invention.

Referring again to FIG. 2A, and further to the detail provided by FIG. 3, outer mandrel 30 of lock 10 extends through barrel slip assembly 14 and packing assembly 40 in a generally coaxial relation therewith. A generally annular engagement member 86 is attached by a threaded coupling 88, or other attachment mechanism, to outer mandrel 30 proximate the upper end thereof. Engagement member 86 is adapted to be removably coupled to a setting tool used to set the lock 10 within the tubing string. Apertures 189 are preferably provided in engagement member 86 to permit the placement of attaching pins (not illustrated) to couple lock 10 to such setting tool.

The lock actuation assembly includes an axial compression member 54 which is disposed around an upper portion of outer mandrel 30. Axial compression member 54 defines a radially extending actuation surface 57 which will engage running and pulling assemblies as will be described in more detail later herein. One or more shear pins 55 are provided to resist motion of compression member 54 with respect to mandrel 30. In a preferred embodiment, two shear pins are provided which present a total shear value of 3000 pounds. A motion restricting assembly, indicated generally at 49, is operatively coupled to axial compression member 54 to allow movement of axial compression member in only a downward direction relative to outer mandrel 30. In this preferred embodiment, motion restriction assembly 49 includes a threaded ring 62 and a split-ring 64 which associate axial compression member 54 with outer mandrel 30. Threaded ring 62 is adapted to restrict axial motion of compression member 54 with respect to outer mandrel 30.

Threaded ring 62 features coarse outer threads **62*a* adapted to threadedly engage a complimentary interior threading on compression member 54. Finer inner threads 63 are provided to engage the exterior surface of outer mandrel 30. Inner threads 63 are adapted to facilitate downward movement of threaded ring 62 relative to outer mandrel 30 upon application of suitable axial force upon ring 62. In one preferred exemplary embodiment, outer threads 62*a* will have a pitch of 6 and a depth of 0.075, while inner threads 62*b* will have a pitch of 8 and a depth of 0.035. One or more guide pins or rotation-limiting pins 65 may be placed through portions of compression member 54 to resist unthreading of ring 62. An access port 68 is provided to permit entry of tools for manipulation of ring 62** during assembly or disassembly.

Split ring 64 is adapted to be movable axially along mandrel 30 during setting of lock 10. The chamfered surface 67 of split ring 64 is adapted to engage matching shoulder surface in recess 66 of outer mandrel 30 during pulling or removal operations. Engagement of split ring 64 with annular recess 66 provides a positive lock of compression member 54 relative to outer mandrel 30. A second access port 69 may be provided to permit entry of tools to manipulate rings 64 in disassembly.

A force distribution ring 70 is provided adjacent split ring 64. Its axial cross-section should provide that axial force may be applied to split ring 64 and maintained upon it once split ring 64 has radially retracted within recess 66. End ring 63 abuts force distributing ring 70 and engages the inner surface of compression member 54 such that as compression member 54 is moved axially downward with respect to outer mandrel 30, end ring 63 transmits the movement to distribution ring 70 and to split ring 64.

Lock 10 further includes a release mandrel assembly 72 disposed within outer mandrel 30 in a generally coaxial relation therewith. One or more shear pins 73 may be placed through portions of release mandrel assembly 72 and outer mandrel 30 to resist axial displacement between the mandrels. In a preferred embodiment, four shear pins are used which present a total shear value of 6000 pounds. Release mandrel assembly 72 is axially extensible in response to diverging axial tension applied proximate its axial ends. In a preferred embodiment, release mandrel 72 includes an upper section 74 and a lower section 76, which are coupled to one another by a selectively releasable connection, such as a threaded connection 78. Releasable threaded connection 78 is configured to release under diverging axial tension of a generally predetermined magnitude applied across upper section 74 and lower section 76 of release mandrel assembly 72, such that the sections separate and become axially spaced from each other. In this preferred embodiment, releasable threaded connection 78 is formed through use of a plurality of threaded collet fingers 91 in lower section 76 of release mandrel assembly 72, such collet fingers defined by a plurality of longitudinal slots 84 in upper section 76 to facilitate radial deflection of lower section 76 proximate threaded connection 78. Other extensible designs for release mandrel 72 may, of course be contemplated, such as shearable telescoping configurations.

A threaded connection 79 may also be provided between collet fingers 91 on lower half 76 of release mandrel assembly 72 and outer mandrel 30. Threaded connection 79 is adapted to maintain a fixed relation between lower section 76 and outer mandrel 30 when upper and lower sections 74 and 76 are engaged. Threaded connection 79 will also be severable under divergent axial tension as upper and lower sections 74 and 76 are separated.

Upper releasable mandrel section 74 includes an internal generally annularly extending actuation surface 80 proximate at its upper end. Similarly, lower releasable mandrel section 76 includes an internal, generally annular, actuation surface 82. Annular actuation surfaces 80 and 82 on upper and lower releasable mandrel sections 74 and 76 facilitate engagement with a pulling or retrieval tool, as will be described later herein, by providing surfaces for receiving the application of divergent axial tension across releasable mandrel 72 assembly to cause the releasing of threaded connections 78 and 79.

Lock 10 further includes a spring assembly 90, which includes one or more springs disposed around lower section 76 of release mandrel 72. The lower end of spring assembly 90 is secured to the release mandrel 72 by a retaining ring 93 which is preferably threadably coupled to lower section 76. Springs 90 are adapted to store energy resulting from the axial compression of portions of lock 10 when lock 10 is set. Telescoping of compression member 54 relative to outer mandrel 30, will cause radial expansion of elastomeric sleeve 42 and setting of barrel slip assembly 14. The same telescoping in compressional force applied through elastomeric sleeve 42 and barrel slip assembly 14 will be transmitted through lower wedge assembly 26 to spring assembly 90. Belleville type springs have been found to be suitable for this purpose. In one preferred embodiment, spring assembly 90 will allow lower wedge assembly 26 to telescope for approximately 3/10 inch relative to release mandrel assembly 72. In this embodiment three opposed stacks of seven Belleville springs were used with each spring requiring 2000 lbs. of stroke over 1/10 inch to flatten, thereby providing a spring assembly adapted to store 14,000 lbs over 3/10 inch of stroke.

Additional equipment may be coupled to the lower end of lower section 76 of release mandrel assembly 72. For example, a pressure equalizing valve assembly 95 will preferably be threadably coupled to lower section 76. Pressure equalizing valve assembly 95 includes a housing 96 having a plurality of radial pressure equalizing ports 97 therein. A moveable sleeve 94 slidingly engages the internal surface of housing 96 to isolate ports 97 when sleeve 94 is retained a first, unactuated position, through interaction of a plurality of collet fingers 98 with an internal ledge 99 in housing 96. As will be described later herein, movement of sleeve 94 to a second, lower, actuated position, uncovers ports 97 allowing fluid communication from the exterior to the lower side of the set lock 10 to the internal bore 19 through lock 10. Additionally, an adapter 92, or other equipment may be threadably coupled to pressure bypass valve 95 to facilitate the coupling of lock 10 with other devices as is well known to the art.

Figure 5:
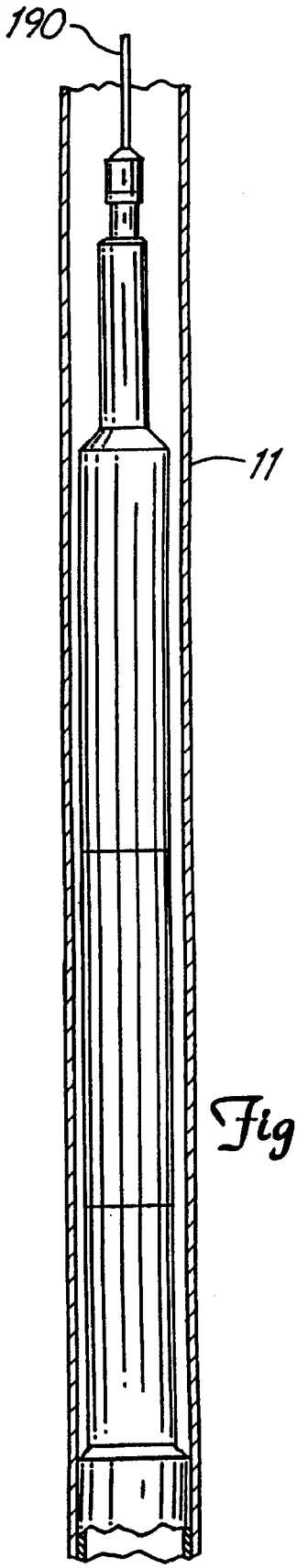
FIG. 5 is a side exterior view of an exemplary downhole power tool constructed in accordance with the present invention.
Figure 9B:
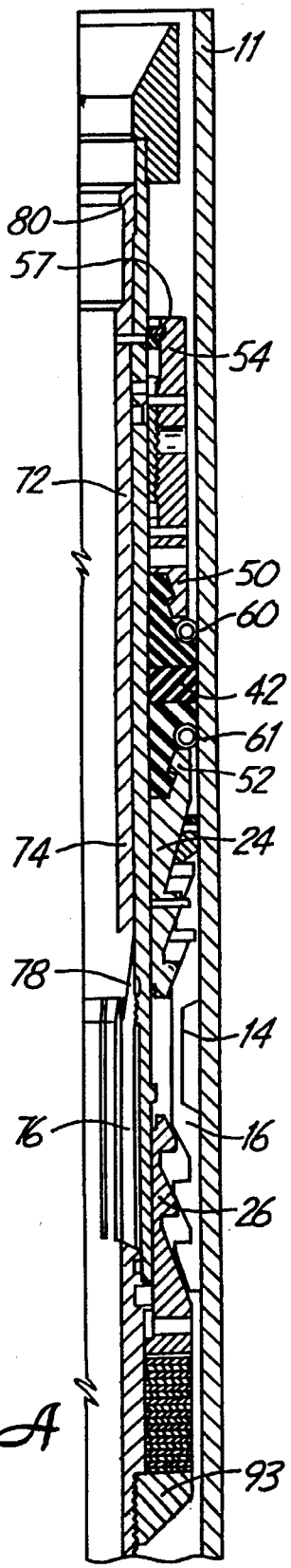

Setting of lock 10 is accomplished by axially displacing annular compression member 54 along outer mandrel 30 through use of a running tool. An exemplary running tool 100 will be set forth in greater detail in reference to FIGS. 5 and 7. Once so displaced, threaded ring 62 prevents displacement of compression member 54 in the opposite direction. As previously discussed, in the expanded diameter condition, as shown in FIG. 9B, movement of upper and lower annular wedge assemblies 24 and 26 of barrel slip assembly 14 toward one another causes radially outward movement of anchoring slips 20 of slip body 16, and deformation of elastomeric sleeve 42 against the tubing.

Figure 9C:
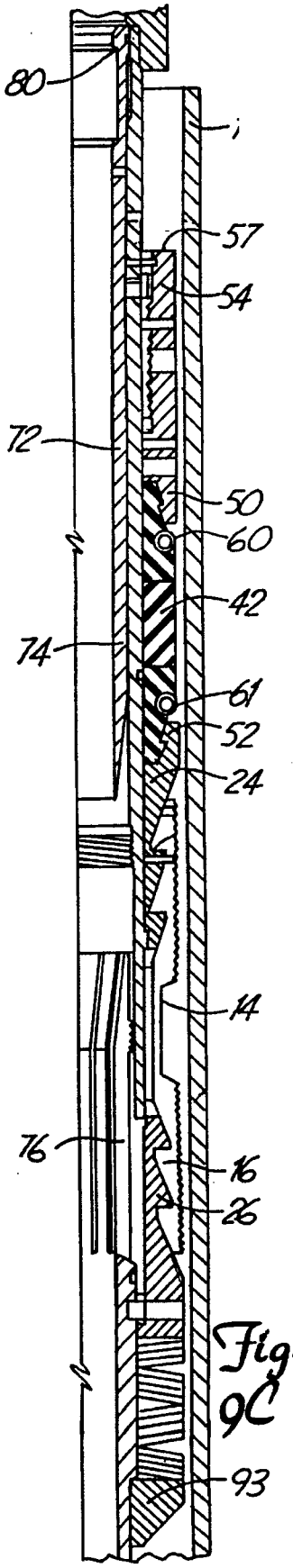

Movement of the lock 10 back to a reduced diameter condition is accomplished by applying divergent axial pressure to annular actuation surfaces 80 and 82 until threaded coupling 78, joining upper and lower sections 74 and 76 of release mandrel assembly 72, decouples and the sections become axially spaced. This operation may be performed through a number of types of conventional equipment known to the industry. Preferably, however, "pulling" of lock 10 will be performed through use of a pulling tool 200 as described later herein. Upon decoupling of the sections of release mandrel 72, the decrease in axial compression will release both elastomeric sleeve 42 and barrel slip assembly 14 from the expanded diameter condition and permit each to return to the reduced diameter condition. This movement may be better understood by referring to FIG. 9B, illustrating a lock before extension of release mandrel 72, and FIG. 9C which illustrates a lock after extension of release mandrel 72.

In the unset condition of lock 10, barrel slip assembly 14 and packing assembly 40 are relatively radially withdrawn so that lock 10 may be easily withdrawn from the tubing string. As previously discussed, sleeve 42 of packing assembly 40 is maintained under divergent axial tension through action of notched members 50 and 52. This axial tension assists in facilitating withdrawal of lock 10 from the tubing, by minimizing the radial dimension of elastomeric sleeve 42 and thereby minimizing drag of elastomeric sleeve 42 against the interior surface of the tubing string and maximizing the fluid bypass area around sleeve 42. Slip body 16 of barrel slip assembly 14 is also radially withdrawn to assist removal from the interior of the tubing string.

As indicated above, the lock 10 may be set and later removed through use of a running tool 100 which sets ("runs") the lock 10, and a pulling tool 200 which removes ("pulls") a set lock 10. In a preferred implementation, either of these tools may be suspended within tubing string 11 by a wireline or slickline 190. Because of the tool's preferred self-contained nature, a monofilament line, or "slickline" is preferred.

Figure 6:
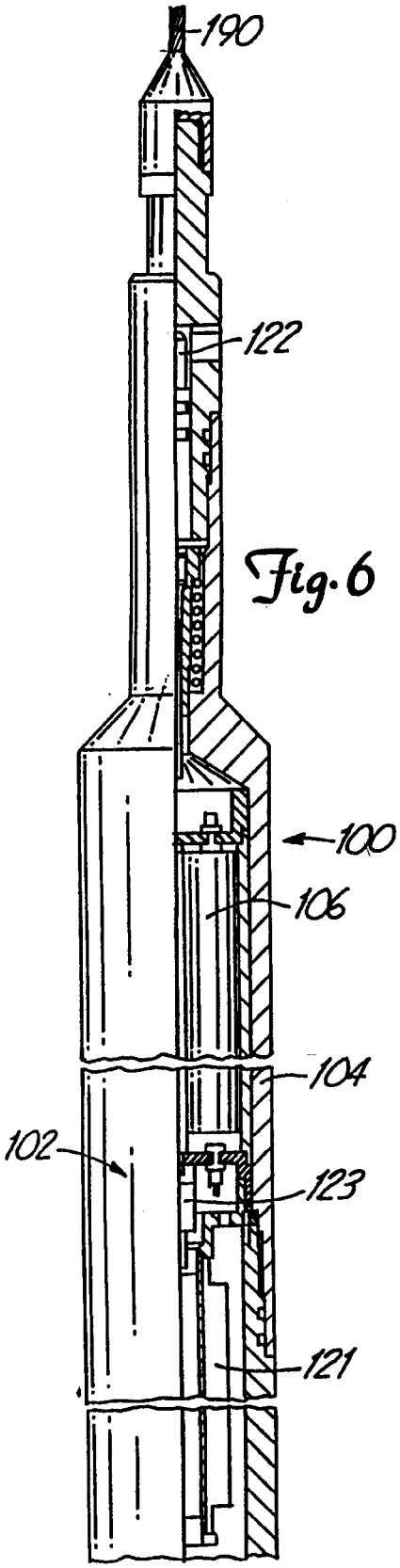
FIG. 6 is a partial vertical section of the power assembly portion of an exemplary running tool constructed in accordance with the present invention.
Figure 7:
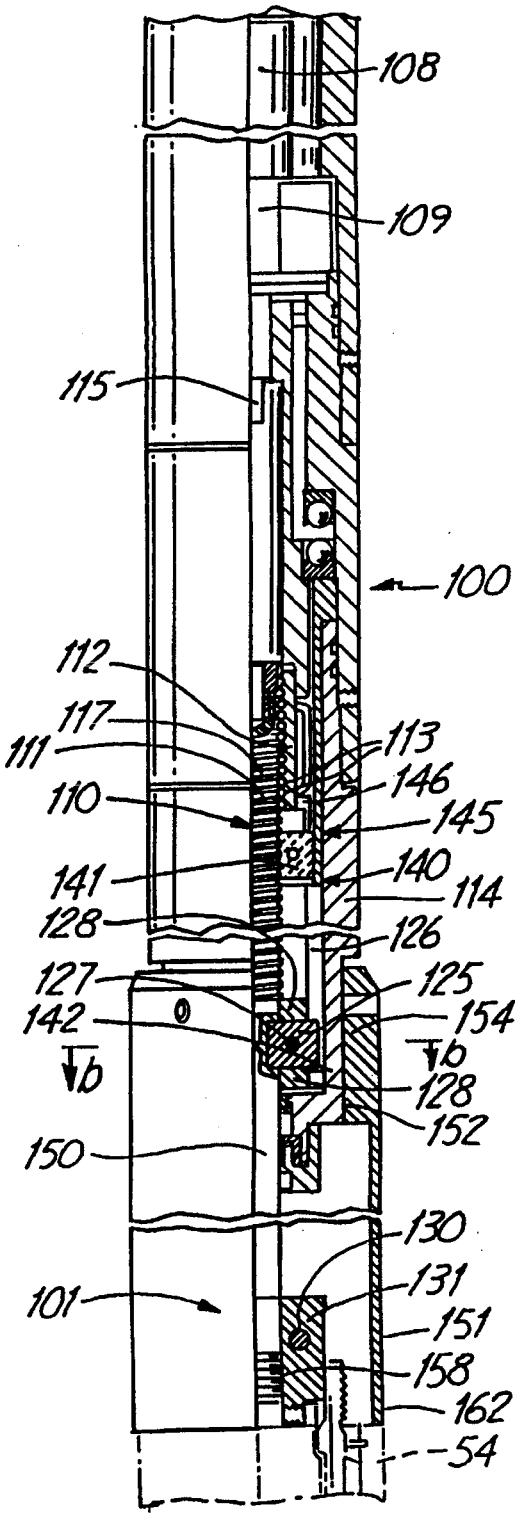
FIG. 7 is a partial vertical section of the working assembly portion of an exemplary running tool constructed in accordance with the present invention.

FIGS. 6 and 7 illustrate in partial vertical section upper and lower portions of an exemplary running tool 100 constructed in accordance with the present invention. Running tool 100 includes a working assembly, indicated generally at 101, and a power assembly, indicated generally at 102. Power assembly 102 includes a housing assembly 104 which comprises suitably shaped and connected generally tubular housing members. An upper portion of housing assembly 104 includes an appropriate mechanism to facilitate coupling of housing 104 to a conveying member such as slickline, coiled tubing, or possibly wireline. Housing assembly 104 also includes a selectively replaceable clutch housing 114 as will be described later herein, which forms a portion of a clutch assembly 145.

Power assembly 102 includes a self-contained power source, eliminating the need for power to be supplied from an exterior source, such as the surface. A preferred power source comprises a battery assembly 106. In one preferred embodiment, battery assembly 106 comprises a pack of 18 C-cell type alkaline batteries.

Power assembly 102 further includes a force generating and transmitting assembly, indicated generally at 110. Force generating and transmitting assembly preferably includes a DC electric motor 108, coupled through a gear box 109, to a jackscrew assembly 110. In a particularly preferred embodiment, a plurality of activation mechanisms 121, 122 and 123, as will be described, will be electrically coupled in series between battery assembly 106 and electric motor 108.

Electric motor 108 may be of any suitable type. However, for the embodiment as described herein, a motor operating at 7500 rpm in unloaded condition, and operating at approximately 5000 rpm in a loaded condition, and having a horsepower rating of approximately 1/30th of a horsepower has been found satisfactory. In the same particularly preferred embodiment, motor 108 is coupled through a gear box 109 which provides approximately 5000:1 gear reduction. Gear box 109 is coupled through a conventional drive assembly 115 to jackscrew assembly 110.

Suitable commercially available motors include Globe type BD DC motors such as the A-2400 motor available from Globe Motor Division of Precision Mechanique Labinal, 2275 Stanley Ave., Dayton, Ohio 45404, (513) 228-3171. Also suitable are BD and BL DC permanent magnet planetary gearmotors such as the A-2430 motors from Globe Motors. Jackscrew assembly 110 is preferably a conventional assembly, such as those manufactured and sold by Warner Electric Brake & Clutch Co. of South Beloit, Ill. 61080, (815) 389-3771 as model R-1105 Ball Screw. This jackscrew assembly includes a threaded shaft 111 which moves longitudinally, at least initially, in response to rotation of the sleeve assembly 112. In this preferred embodiment, threaded shaft 111 will be a 5 pitch shaft. Threaded shaft 111 includes a threaded portion 117, and a generally smooth, polished lower extension 150. Threaded shaft 111 further includes a pair of generally diametrically opposed keys 125 which cooperate with a clutch block 128 which is coupled to threaded shaft 111.

Clutch housing 114 includes a pair of diametrically opposed keyways 126 which extend along at least a portion of the possible length of travel of housing 142. Keys 125 extend radially outwardly from threaded shaft 111 through clutch block 128 to engage each of keyways 126 in clutch housing 142 thereby preventing rotation of threaded shaft 111 relative to housing assembly 114.

As will be appreciated by those skilled in the art, rotation of sleeve assembly 112 will cause threaded shaft 111 and clutch block 128 to move longitudinally upwardly relative to housing assembly 114. Above a certain level within clutch housing 142, is indicated generally at 140, clutch housing 114 includes a relatively enlarged internal diameter bore 146 such that moving clutch block 128 above level 140, removes the outwardly extending key 125 from being restricted from rotational movement. Accordingly, continuing rotation of collar assembly 112 will cause longitudinal movement of threaded shaft 111 until such time as clutch block 128 rises above level 140, at which time rotation of sleeve assembly 112 will also result in free rotation of threaded shaft 111. By virtue of this result, clutch assembly 145 serves as a safety device to prevent burn-out of the electric motor, and also serves as a stroke limiter.

In preferred embodiments, running tool 100 incorporates one or more activation assemblies which enable the jack-screw 110 to operate upon the occurrence of one or more predetermined conditions. This is particularly desirable when the tool is employed to run a lock as the activation assemblies help insure that the lock is not inadvertently set at an improper location in the tubing string. Setting tool 100 preferably includes a plurality of activation assemblies and most preferably will include each of the three activation assemblies as discussed below.

The activation assembly may comprise timing circuitry 121 of a type known in the art which is adapted to provide power from battery source 106 to electric motor 108 and gear box 109 and thereby to jack-screw 110 after passage of a predetermined amount of time. Further, running tool 100 may include an activation assembly including a pressure-sensitive switch 122 of a type generally known in the art which will operate to provide power from battery source 106 to electric motor 108 and gear box 109 and thereby to jack screw assembly 110 once the switch 122 reaches a depth at which it encounters a predetermined amount of hydrostatic pressure within the tubing string. Further, running tool 10 will preferably include an accelerometer 123, sensitive to vertical motion of setting tool 100. Accelerometer 123 may be combined with timing circuitry 121 such that when motion is detected by the accelerometer 123, the timing circuitry 121 is reset. If so configured, the activation assembly would operate to provide power from battery source 106 to jack-screw 110 after the accelerometer 123 detects that running tool 100 has remained substantially motionless within the tubing string for a predetermined amount of time.

Also depicted in FIG. 7 is a working assembly 101 of a running tool 100 in accordance with the present invention. Working assembly 101 includes an actuation assembly 151 which is coupled through housing assembly 104 of power assembly 102 to be movable therewith. Actuation assembly 151 includes an outer sleeve member 154 which is threadably coupled at 152 to housing assembly 104 of power assembly 102. Working assembly 101 also includes a connecting sub 131 which is threadably coupled at 158 to a lower end of the otherwised polished portion 150 of threaded shaft 111. Connecting sub 131 facilitates seating of working assembly 101 adjacent engagement member 86 of block 10, and the securing of working assembly 101 to engagement member 86 through use of shear pins 130. Shear pins 130 are adapted to shear and disconnect lock 10 from running tool 100 upon application of a predetermined shear load. The predetermined shear load should generally correspond to an amount slightly greater than that required to move the barrel slip assembly 14 and packing assembly 40 into their expanded diameter conditions. When running tool 100 is coupled to lock 10 through engagement of shear pin 130 with connecting sub 131 and engagement member 86, the placement of outer sleeve 154 will be adjusted such that the lower proximate end 162 of sleeve 154 contacts compression member 54 of lock 10. The described running tool 100 is configured to permit an extended duration setting sequence for a downhole lock. Preferably, the running tool is configured such that the tool's setting sequence requires more than one minute of setting time to move portions of the lock to an expanded diameter condition from a reduced diameter condition. Optimally, setting times over five minutes will be obtained. In embodiments as described herein, wherein the travel of compression block 54 during the setting sequence will be 2.25 inches, on the order of setting times between 6 and 20 minutes have been observed.

Running tool 100 is adapted to cooperate with lock 10 so as to move packing assembly 40 and barrel slip assembly 14 from reduced diameter conditions to expanded diameter conditions by engagement of outer sleeve 151 with axial compression member 54 of the lock 10 and the exerting of axial force upon compression member 54 by downward axial movement of outer member 151 with respect to lock 10. Accordingly, as will be appreciated from the above discussion, actuation of motor 108 by activation assemblies 121, 122 and 123, and the resulting longitudinal movement of threaded screw 111 will cause a relative downward movement of housing assembly 114 and outer sleeve 154 relative to lock 10. This relative downward movement will shear shear pins 55 securing compression member 54 in an initial, unactuated, position relative to central mandrel 30 and will thereby cause the previously described compression and radial expansion of packing assembly 40 and the longitudinal movement of annular wedges 24 and 26.

Figure 10A:
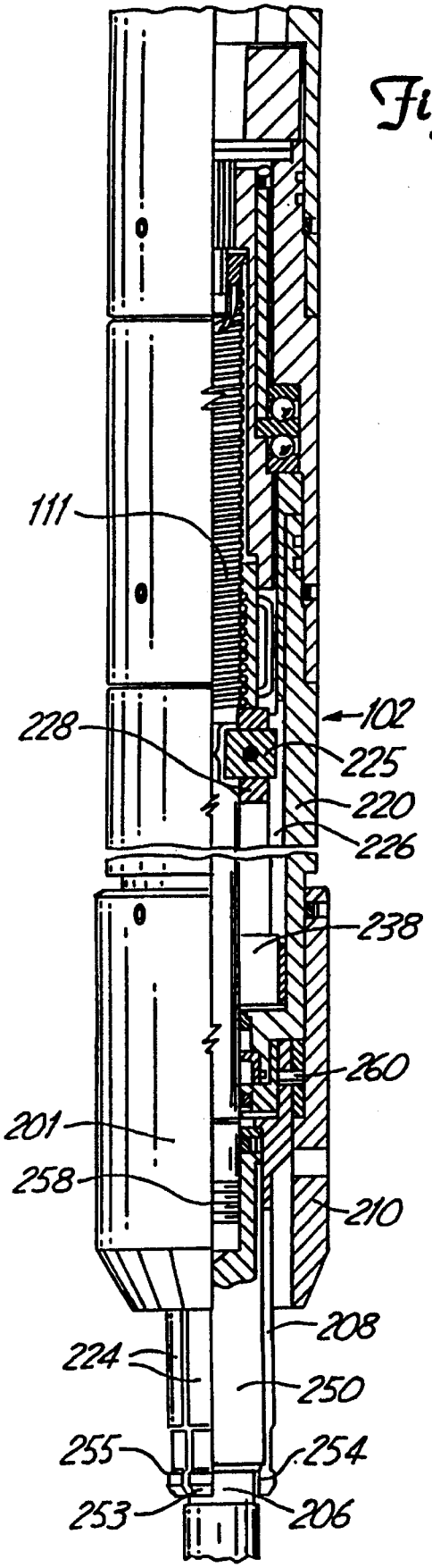
FIGS. 10A and 10B are partial cutaway views of an exemplary pulling tool constructed in accordance with the present invention.
Figure 10B:
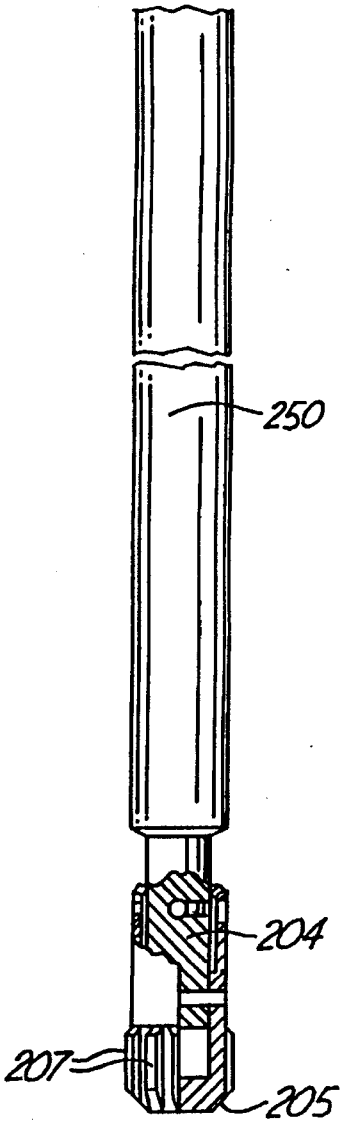

Referring now to FIGS. 10A and 10B, therein is depicted an exemplary pulling tool 200 in accordance with the present invention. Pulling tool 200 may again be suspended by either wireline or slickline. Pulling tool 200 preferably comprises a power assembly identical 102 to that described relative to running tool 100 with the single exception that clutch housing 142 of power assembly 102 will be interchanged for a clutch housing 220, as will be described in more detail later herein.

Working assembly 201 includes an inner member assembly 250 which is threadably coupled at 258 to a lower proximate end of threaded shaft 111. Inner member assembly 250 is a generally elongated member which will extend through central bore 19 of lock 10. Inner member assembly 250 includes an engagement shoe 205 coupled to its lower proximate end. Engagement shoe 205 includes a plurality of generally radially extending members 207 which facilitate inner member assembly 250 contacting pressure bypass sleeve 94 and lower annular engagement surface 82 in a manner which will be described later herein. Working assembly 201 also includes a collet assembly 208 which is retained by an outer housing assembly 210. Outer housing 210 is again threadably coupled at 152 to power tool 102.

Clutch housing 220 is similar to that described relative to clutch housing 114 of running tool 100, with the exception that, because clutch block 228 will travel downwardly relative to threaded shaft 111 during operation of pulling tool 200, the relatively enlarged relief bore 238 will be provided toward a lower end of clutch housing 220, rather than toward an upper end as described relative to clutch housing 114. Accordingly, in the manner similar to that previously described relative to clutch housing 114, the clutch assembly which acts a stroke limiter upon longitudinal movement effected by power assembly 102, and which further prevents damage to power assembly 102 through uncontrolled actuation.

Figure 11A:
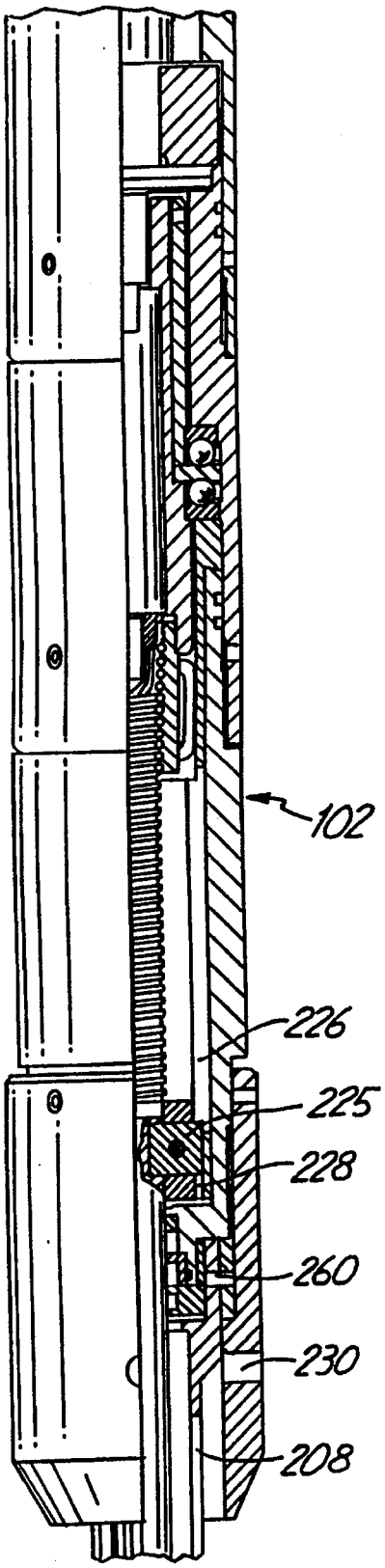
FIGS. 11A–11C are partial cutaway views of an exemplary pulling tool and an associated lock.
Figure 11B:
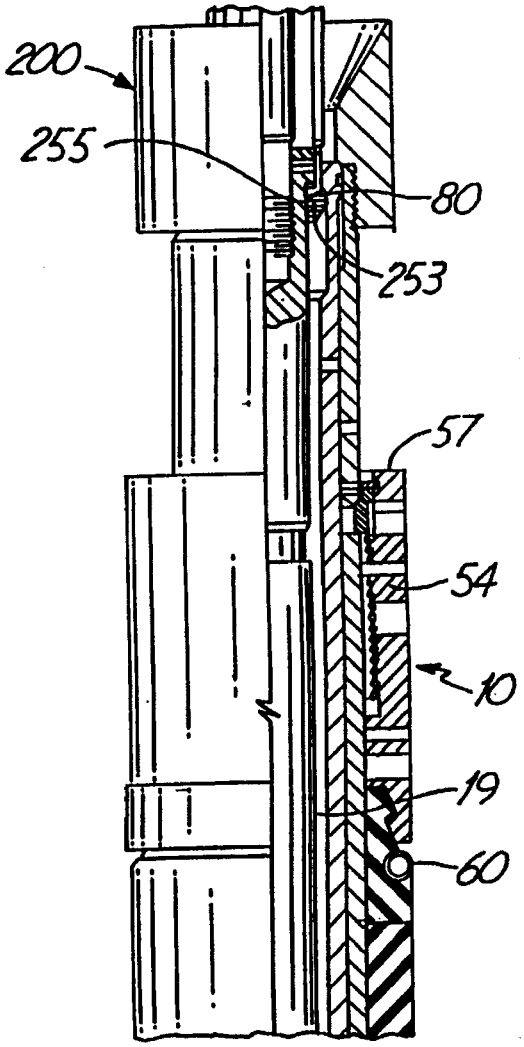
Figure 11C:
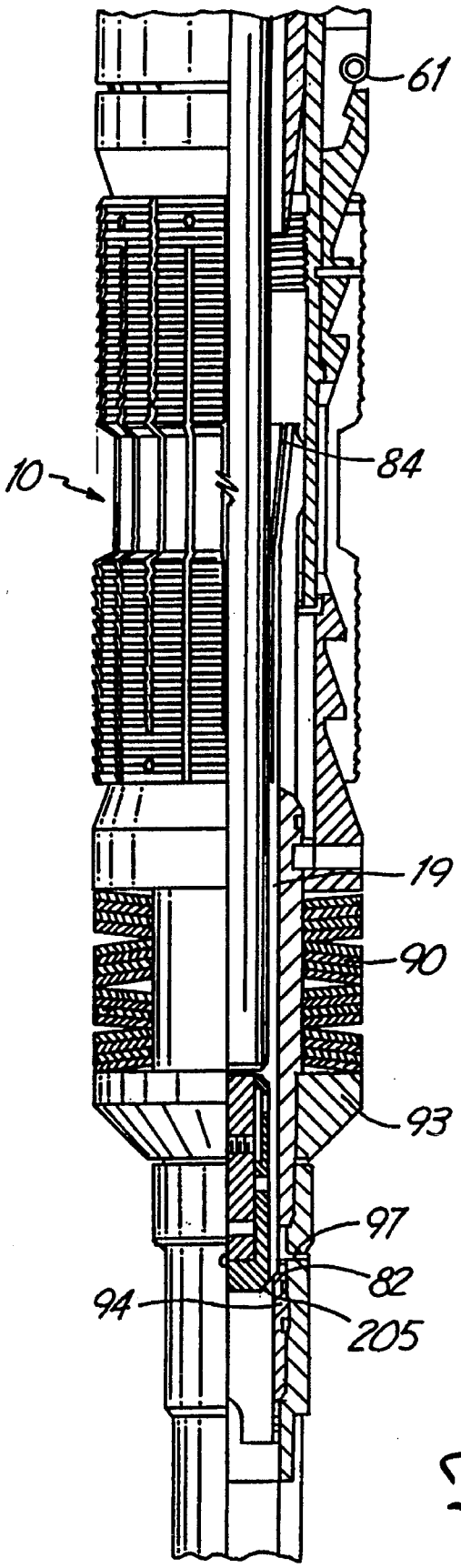

When it is desired to utilize pulling tool 200 to remove lock 10 from its set engagement with the tubing string, pulling tool 200 will be lowered into the tubing string to the point at which lock 10 has been placed. The inner member assembly 250 and collet assembly 208 are inserted within lock 10 and release mandrel assembly 72 until outer housing 210 contacts engagement member 86. At this point collet fingers 224 will be below the level of upper member engagement surface 80. During this insertion engagement shoe 205 will engage pressure bypass sleeve 94, and move it to a relatively downward position as depicted in FIG. 11C. Movement of pressure equalization sleeve 94 establishes a flow path through pressure equalization port 97 and up through central bore 19 of lock 10. Central bore 19 will then communicate, through the slots defining collet fingers 224 with an upper bypass port 230 in outer housing 210 of pulling tool 200 to facilitate pressure equalization across lock 10 so as to thereby facilitate removal.

Preferably, the above described activation assemblies of power assembly 102 will then be automatically actuated, or will be caused to actuate to initiate operation of jack-screw assembly 110 in the manner previously described herein. As described previously, in the operation of pulling, power assembly 102 will be arranged to impart a generally downwardly directed movement of threaded screw 111 relative to housing assembly 104 rather than relatively upward movement as described relative to running tool 100.

As threaded screw 111 and associated inner member assembly 250 move downwardly lower contact member 205 will travel to engage lower annular engagement surface 82. Further, the inner extensions 254 of collet enlargements 253 are displaced from residence in recess 206 in inner member assembly 250. The outer extensions 255 of collet enlargements 253 thereby engage upper internal annular surface 80 thereby securing the lower end of expansible connector 252, and thereby pulling tool 200, to upper section 74 of release mandrel assembly 72.

Continued axial movement of threaded shaft 111 and inner member assembly 250 will result in lower engagement member 205 engaging lower internal annular surface 82 applying increased axial load across release mandrel assembly 72. Continued movement of inner member 250 will eventually cause the opposing engagements of outer portion 255 with annular surface 80 and engagement member 205 with lower member surface 82 to exert sufficient axial tension upon release mandrel 72 to cause it to separate, causing axial spacing of upper and lower sections 74, 76. FIGS. 11A–11C illustrate tool 200 following downward axial movement of inner member 250 and extension of release mandrel 72.

Upon extension of release mandrel 72, compression energy stored in spring assembly 90 is released and lock 10 is returned to a reduced diameter condition. Elastomeric sleeve 42 is axially drawn, as previously described by notched members 50 and 52 to a reduced diameter condition. Further, wedges 24 and 26 are permitted to move divergently to return barrel slip assembly 14 to a reduced diameter condition.

By virtue of the engagements of annular shoulder 205 with internal ring seat 82 and outer portion 255 of enlargement 253 with internal ring seat 80, lock 10 becomes affixed to pulling tool 200. As pulling tool 200 is raised, thereby raising upper section 74 of release mandrel assembly 72, and thereby outer mandrel 30, snap ring 64 will engage recess 66 in outer mandrel 30 to provide a mechanical lifting shelf to support the remaining elements of lock 10 during removal. Lock 10 may then be removed from the well by withdrawal of pulling tool 200.

The pulling tool 200 offers an optional emergency release feature by which collet assembly 208 may be disconnected from the working assembly of tool 200 in the event that the lock 10 is functioning improperly or cannot be returned to its reduced diameter condition. As shown in FIGS. 10A and 11A, a shear pin 260 affixes the upper portion of collet assembly 208 with respect to outer housing 210. Upon severance of the shear pin 260 by movement of collet assembly 208 with respect to outer housing 210, the collet assembly 210 becomes disconnected from tool 200. In this manner, lock 10 is released from its affixation to pulling tool 200. Tool 200 may then be removed from the tubing string. The shear pin 260 should be adapted to shear in response to a predetermined shear load generally corresponding to an amount of force greater than that required to move the barrel slip assembly 14 and packing assembly 40 into their expanded diameter conditions.

The foregoing description of invention has been directed to particular preferred embodiments in accordance with the requirements of the patent statutes and for purposes of explanation and illustration. It will be apparent, however, to those skilled in the art that many modifications and changes may be made without departing from the scope of the claims. It is intended in the following claims to cover all such equivalent modifications and variations which fall within the spirit and scope of the invention.

What is claimed is:

1. A tool for setting a lock in a subterranean well, said lock comprising an actuation assembly operable through relative longitudinal movements between first and second portions of said lock, said running tool comprising:

a. a housing assembly b. an electric motor contained within said housing assembly;

c. a power source contained within said housing assembly, said power source capable of providing a supply of electrical power sufficient to operate said electric motor;

d. a movable mandrel, said movable mandrel configured to be longitudinally movable relative to said housing assembly in response to operation of said electric motor, said movable mandrel selectively engageable with a first portion of said lock, said housing assembly operatively engageable with said second portion of said lock, whereby operation of said electric motor and the resulting movement of said movable mandrel of said tool relative to said housing assembly will cause actuation of said lock; and e. an activation assembly, the activation assembly comprising:

i. a pressure sensitive switch arranged to be selectively operable in response to hydrostatic pressure within said well to selectively provide power from assembly to said motor;

ii. timing circuitry configured to selectively provide power from said battery source to said motor after the passing of a predetermined time period; and iii. an accelerometer, operatively coupled to the timing circuitry such that motion detected by said accelerometer resets said timing circuitry.

2. The tool of claim 1, wherein said power source comprises a battery assembly.

3. The tool of claim 1, wherein said movable mandrel is movable generally upwardly relative to said housing assembly.

4. The tool of claim 1, wherein said movable mandrel is operatively coupled to said housing assembly through a jackscrew assembly.

5. The tool of claim 4, wherein said housing assembly is coupled to the screw portion of said jackscrew assembly, and wherein said movable mandrel is operatively associated with the follower portion of said jackscrew assembly.

6. The tool of claim 1, further comprising a coupling for securing said tool to said lock.

* * * * *